US005460558A

United States Patent [19]

Woodstock

[11] Patent Number: 5,460,558

[45] Date of Patent: Oct. 24, 1995

[54] SURFBOARD FOOT SADDLE

[76] Inventor: John F. Woodstock, 18544 127th Dr. N., Jupiter Farms, Fla. 33478

[21] Appl. No.: 249,722

[22] Filed: May 26, 1994

[51] Int. Cl.[6] ..... B63B 35/79

[52] U.S. Cl. ..... 441/74; 280/14.2

[58] Field of Search ..... 441/65, 68, 70, 441/75, 74; 280/14.2, 624; 114/39.2

[56] References Cited

U.S. PATENT DOCUMENTS

| | | | |
|---|---|---|---|
| 4,645,466 | 2/1987 | Ellis | 441/74 |
| 4,840,590 | 6/1989 | Kelley | 441/74 |
| 4,846,744 | 7/1989 | Love | 441/75 |
| 4,902,256 | 2/1990 | Berglund | 441/74 X |
| 4,990,113 | 2/1991 | Morrison | 441/75 |
| 5,122,085 | 6/1992 | Heath | 441/74 X |

*Primary Examiner*—Sherman Basinger
*Attorney, Agent, or Firm*—Richard L. Miller

[57] ABSTRACT

A foot saddle is provided for a surf board having a deck, a nose end, and a tail end. The foot saddle consists of a structure adjustable to fit any size foot, for maintaining one foot of a surfer in a stationary position upon the deck near the tail end of the surfboard, and help prevent the surfer's foot from inadvertently sliding off the surfboard. The other foot of the surfer is free to move upon the deck to ride the nose and the fin of the surfboard on the crests of waves with a better balance.

5 Claims, 1 Drawing Sheet

SURFBOARD FOOT SADDLE

BACKGROUND OF THE INVENTION

The instant invention relates generally to surfboard/sailboard equipment and more specifically it relates to a surfboard foot saddle.

Numerous surfboard/sailboard equipment have been provided in prior art that are adapted to assist surfers in maintaining their balance and maneuverability when riding on surfboards and sailboards. For example, U.S. Pat. Nos. 4,645,466 to Ellis; 4,846,744 to Love and 4,990,113 to Morrison all are illustrative of such prior art.

While these units may be suitable for the particular purpose to which they address, they would not be as suitable for the purposes of the present invention as heretofore described.

SUMMARY OF THE INVENTION

A primary object of the present invention is to provide a surfboard foot saddle that will overcome the shortcomings of the prior art devices.

Another object is to provide a surfboard foot saddle being a two piece structure for mounting onto a tail section of a surfboard, so that the surfer can place the outer side edge of one foot against the saddle for balance, enhancing performance, while turning critically upon wave face.

Yet another object is to provide a bolster which is curved to form the contour of the foot and thus adding considerable leverage for the surfer to lock in and push against during maneuvers which require excessive stress.

Yet another object is to increase the available surface area provided on the surfboard so as to allow the rider to be in more contact to the deck of the surf board.

Yet another object is by positioning the device in the most advantageous area the rider is provided with an optimum position for performance as the device is as the device is positioned best use of the surfboard fins.

Yet another object is that a fulcrum is created by the riders heel and toes because of augmented pressures due to the lever wedge effect that occurs when the contoured surfaces are pushed upon.

Yet another object is to provide a cupping or bolstering area for heel, outside portion of the foot and for the toes. This is done by the curves and contours inherent in the device and by the heights and width of the material.

Yet another object is to provide a surfboard foot saddle being a two piece structure for mounting onto a tail section of a surfboard, so that the surfer can adjust the size of the saddle to best fit his/her individual foot.

An additional object is to provide a surfboard foot saddle which is contoured for a proper fit to the foot, so as to give comfort and stability to the surfer when riding on the surfboard.

A further object is to provide a surfboard foot saddle that is simple and easy to use.

A still further object is to provide a surfboard foot saddle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
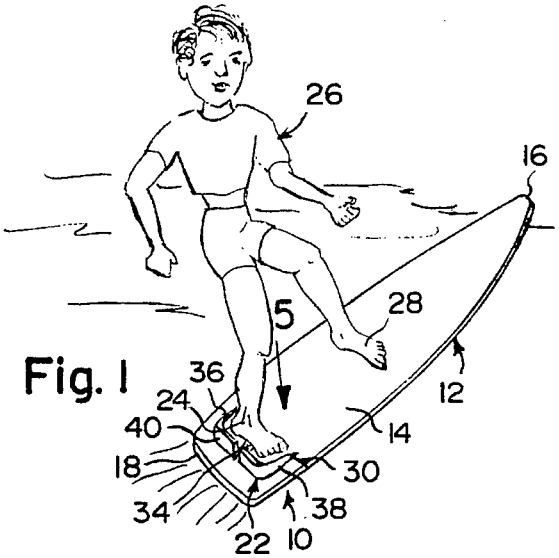
FIGS. 1 and 2 are diagrammatic perspective views illustrating the instant invention mounted on a surfboard being utilized by both right and left foot positioned surfers.
Figure 2:
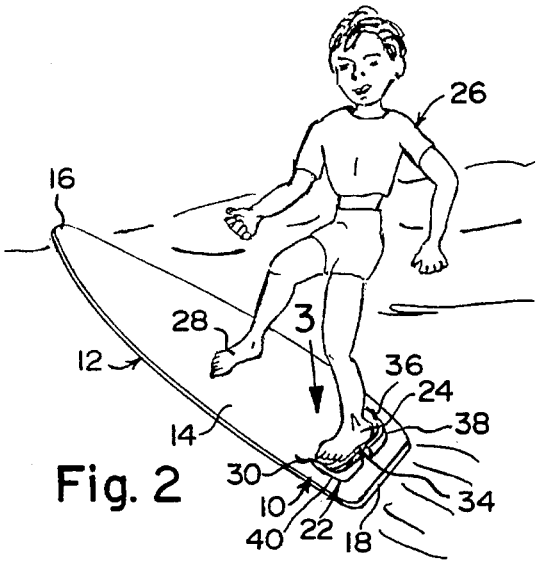
Figure 3:
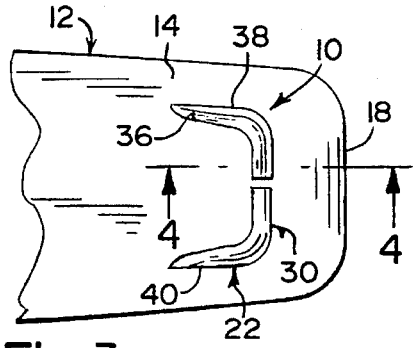
FIG. 3 is an enlarged top view taken in the direction of arrow 3 in FIG. 2 of the tail end of a surfboard illustrating the relative placement of the instant invention thereon.
Figure 4:
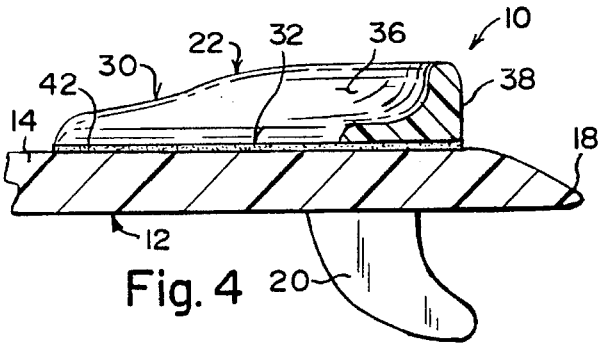
FIG. 4 is a further enlarged cross sectional view taken on line 4—4 of FIG. 3.
Figure 5:
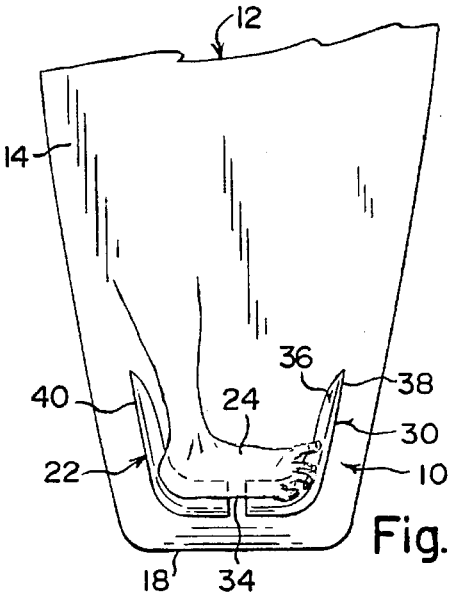
FIG. 5 is an enlarged top view taken in the direction of arrow 5 in FIG. 1 of the tail end of the surfboard illustrating the foot position of a typical surfer.
Figure 6:
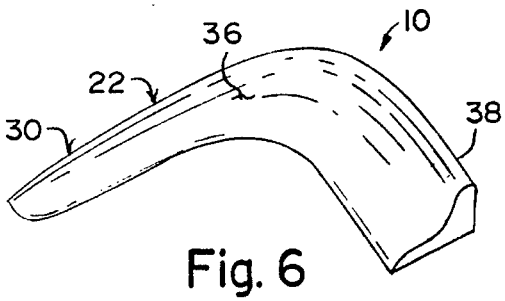
FIG. 6 is a diagrammatic perspective view of just half of the instant invention per se.

Turning now descriptively to the drawings, in which similar reference characters denote similar elements throughout the several views, FIGS. 1 through 6 illustrate a foot saddle 10 for a surfboard 12 having a deck 14, a nose end 16, a tail end 18 and a fin 20. The foot saddle 10 consists of a structure 22 for maintaining one foot 24 of a surfer 26 in a stationary position upon the deck near the tail end of the surfboard and help prevent the surfer's foot 24 from inadvertently sliding off the surfboard. The other foot 28 of the surfer 26 is free to move upon the deck 14, to ride the nose 16 and the fin 20 of the surfboard 12 on the crests of waves with a better balance. In FIG. 1, the stationary foot 24 is a right foot, while the stationary foot 24 in FIG. 2 is a left foot whereby right footed and left footed surfers 26 can use the foot saddle 10.

The foot maintaining structure 22 is formed of two substantially L-shaped halves 38 and 40 which when secured to the surf board juxtaposed to each other form a substantially C-shaped member 30, having a central split. An adhesive material 42 is utilized for attaching the L-shaped members 38 and 40 to the deck 14 of the surfboard 12 near the tail end 18, so that the surfer 26 can place an outer side edge 34 of the one foot 24 against the C-shaped member 30 thus formed.

The L-shaped members 38 and 40 have a contoured surface 36. The two L-shaped members 38, 40 can be positioned onto the deck 14 of the surfboard 12, to give comfort to any sized foot 24 and provide stability to the surfer 26 when riding on the surfboard 12. Thus, the L-shaped members have an inner ramp portion surrounded by an outer shoulder portion which are contoured to provide together forward and laterally inwardly facing concave surfaces engaging under and around outside edge portions of the user's foot, respectively, thereby cupping outer edge portions of both a user's heel and toes to provide a counter abutment to weight applied both rearward and laterally, to maintain the rear foot in a stationary position upon the deck near the tail end of the surfboard.

The adhesive material 42 applied between the bottom surface of the two L-shaped members 38, 40 and the top surface on the deck 14 of the surfboard 12. The two L-shaped members 38, 40 are fabricated out of a resilient somewhat flexible hard rubber or plastic and will cold flow sufficiently to take on the same contour as the surface 42 of the surfboard 12, when clamped in place until the adhesive 32 has cured, thus adhering the L-shaped members 38, 40 to the deck 14 of the surfboard 12.

OPERATION OF THE INVENTION

To use the foot saddle 10 the surfer 26 simply applies the adhesive material 32 onto the bottom surfaces of the two L-shaped members 38, 40 to form a substantial C-shaped member 30 and then places them onto the deck 14 near the tail end 18. The two L-shaped members 38, 40 are so positioned that the outside edge 34 of the foot 24 can be placed against the contoured surface 36. The other foot 28 is free to move upon the deck 14, to control the surfboard 12 when the surfer 26 rides the surfboard 26 on the crests of waves.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A foot saddle for a surfboard having an elongate deck, a nose end and a tail end at respective longitudinal ends of the deck, said foot saddle comprising:

a) two L-shaped members for forming a generally C-shaped member when juxtaposed; and b) means for attaching said two L-shaped members to the deck of the surfboard near the tail end, juxtaposed at a selected distance apart from each other matching a size of a surfer's rear foot;

and so that the members extend supportingly rearwardly and laterally outside a surfer's heel and toes, respectively, to provide counter abutments to weight applied both rearward and laterally, shifted between the heel and toes to maintain the rear foot in a stationary position upon the deck near the tail end of the surfboard, so that the other foot of the surfer is free to move upon the deck to ridge the nose of the surfboard on the crests of waves with a better balance.

2. A foot saddle as recited in claim 1, wherein said attaching means is adhesive material applied between the bottom surfaces of said two L-shaped members and the top surface on the deck of the surfboard, so that said two L-shaped members will adhere to the deck of the surfboard.

3. A foot saddle as recited in claim 2, wherein said two L-shaped members are fabricated out of a resilient plastic.

4. A foot saddle as recited in claim 2, wherein said two L-shaped members are fabricated out of a resilient hard rubber.

5. A foot saddle for a surfboard having an elongate deck, a nose end and a tail end at respective longitudinal ends of the deck, said foot saddle comprising:

a) two L-shaped members for forming a generally C-shaped member when juxtaposed; and b) means for attaching said two L-shaped members to the deck of the surfboard near the tail end, juxtaposed at a selected distance apart from each other matching the size of a surfer's rear foot;

the L-shaped members each having an inner ramp portion surrounded by an outer shoulder portion which are contoured to provide together forward and laterally inwardly facing concave surfaces engaging under and around outside edge portions of the user's foot, respectively, thereby cupping outer edge portions of both a user's heel and toes to provide a counter abutment to weight applied both rearward and laterally, to maintain the rear foot in a stationary position upon the deck near the tail end of the surfboard, so that the other foot of the surfer is free to move upon the deck to ride the nose of the surfboard on the crests of waves with a better balance.

* * * * *